United States Patent [19]

Murasaki et al.

[11] Patent Number: 4,944,264

[45] Date of Patent: Jul. 31, 1990

[54] CHAIN CASING FOR ENGINE

[75] Inventors: Akira Murasaki, Yokohama; Masayuki Hashimoto, Kanagawa, both of Japan

[73] Assignees: Nissan Motor Co., Ltd., Yokohama; Nissan Kohki Co., Ltd., Kanagawa, both of Japan

[21] Appl. No.: 433,894

[22] Filed: Nov. 9, 1989

[30] Foreign Application Priority Data

Nov. 15, 1988 [JP] Japan ..... 63-148722[U]

[51] Int. Cl.[5] ..... F02F 7/00

[52] U.S. Cl. ..... 123/195 C; 123/196 R; 184/6.5

[58] Field of Search ..... 123/195 C, 196 R, 90.31; 184/6.5

[56] References Cited

U.S. PATENT DOCUMENTS

| | | | |
|---|---|---|---|
| 3,418,994 | 12/1968 | Freyn | 123/90.31 |
| 4,121,558 | 10/1978 | Sakakibara et al. | 123/196 R |
| 4,122,818 | 10/1978 | Hattori | 184/6.5 |
| 4,553,473 | 11/1985 | Ichida et al. | 123/90.31 |
| 4,589,382 | 5/1986 | Tsuboi | 123/196 R |
| 4,677,948 | 7/1987 | Candea | 123/196 R |
| 4,729,348 | 3/1988 | Okada et al. | 123/195 C |

FOREIGN PATENT DOCUMENTS

| | | | |
|---|---|---|---|
| 0124433 | 11/1984 | European Pat. Off. | 123/195 C |
| 60-50208 | 3/1985 | Japan . | |
| 0012031 | 1/1989 | Japan | 123/195 C |

*Primary Examiner*—David A. Okonsky
*Assistant Examiner*—Weilun Lo
*Attorney, Agent, or Firm*—Foley & Lardner, Schwartz, Jeffery, Schwaab, Mack, Blumenthal & Evans

[57] ABSTRACT

To allow engine lubricant to quickly and smoothly flow downward along the inner wall surfaces of the chain casing formed in front of an engine having at least one camshaft, an idler sprocket, and first and second chains, the chain casing is composed of a head side chain casing fixed to a front end of the cylinder head, a rocker cover fixed to top ends of the cylinder head and the head side chain casing, and a block side chain casing fixed to a front end of the cylinder block in such a way that lubricant can flow downward on the basis of gravity along the inner wall surfaces of the chain casing.

3 Claims, 3 Drawing Sheets

CHAIN CASING FOR ENGINE

BACKGROUND OF THE INVENTION

1. Field of the Invention

The present invention relates to a chain casing for an engine and more specifically an engine chain casing for enabling a smooth lubricant recirculation within the engine including an idler sprocket and two chains.

2. Description of the Prior Art

To obtain higher engine performance in automotive vehicles, double overhead camshaft (DOHC) engines have been widely used, in which two different camshafts for driving intake and exhaust valves separately are mounted on a cylinder head. An example of DOHC engines is disclosed in Japanese Published Unexamined (Kokai) Patent Appli. No. 60-50208. In this document, as shown in FIG. 1, an idler sprocket 1 is rotatably disposed between two camshafts 2 supported on the cylinder head CYH and a crankshaft 3 supported on the cylinder block CYB, and further a first chain 4A is reeved around the crankshaft 3 and the idler sprocket 1 and a second chain 4B is reeved around the idler sprocket 1 and the two camshafts 2 in order to drive the two camshafts 2 by the crankshaft 3 via the idler sprocket 1. In the prior-art DOHC engine, a chain chamber CHC for accommodating the idler sprocket 1 and the first and second chains 4A and 4B is covered by a rocker cover 5 fixed to the upper portion of a cylinder head CYH, a head side chain casing 6 fixed to the front end of the cylinder head CYH, and a block side chain casing 7 fixed to the front end of a cylinder block CYB.

In the above-mentioned arrangement, however, since the second chain 4B reeved around the idler sprocket 1 and the camshafts 2 is located in front of the first chain 4A reeved around the idler sprocket 1 and the crankshaft 3, the head side chain casing 6 for covering the second chain 4B and the idler sprocket 1 projects frontward from the front end of the cylinder head, with a result that two flat shoulder (or stepped) portions A and B are formed under the camshafts 2 and the idler sprocket 1, respectively. Therefore, in the prior-art chain casing for an engine, there exists a problem in that lubricant to be returned to an oil pan is accumulated and dried at these shoulder portions A and B and therefore a sufficient quantity of lubricant is not recirculated through an oil pump (not shown) due to malsuction of the oil pump.

SUMMARY OF THE INVENTION

With these problems in mind, therefore, it is the primary object of the present invention to provide a chain casing for an engine by which lubricant on the inner wall surfaces of the chain casing can be smoothly returned to the oil pan without accumulation and therefore a sufficient quantity of lubricant can be recirculated through the oil pump for providing a stable lubricant supply to various engine elements.

To achieve the above-mentioned object, the chain casing for an engine having at least one camshaft (50) mounted on a cylinder head (10) and a crankshaft (90) attached to a cylinder block (16), according to the present invention, comprises: (a) at least one camshaft sprocket (51) coaxially coupled to the at least one camshaft; (b) an idler sprocket (60) rotatably supported between the camshaft and the crankshaft and on the cylinder block; (c) a first chain (68) reeved around the crankshaft and said idler sprocket to rotate said idler sprocket by the crankshaft; (d) a second chain (69) reeved around said idler sprocket and said camshaft sprocket to rotate said camshaft sprocket by said idler sprocket; and (e) a chain casing (103, 101, 102) fixed to both ends of the cylinder head and the cylinder block, said chain casing being formed with inner wall surfaces along which lubricant can smoothly flow downward on the basis of gravity without being accumulated midway therealong.

Further, the chain casing comprises: (a) a head side chain casing (101) fixed to a front end of the cylinder head, for covering said second chain; (b) a rocker cover (103) fixed to a top end of the cylinder head and to said head side chain casing, for covering said second chain in cooperation with said head side chain casing; and (c) a block side chain casing (102) fixed to a front end of the cylinder block, for covering said first chain, a first joint portion (101B, 102A) between said head side chain casing and said block side chain casing being located farther frontward away from the front end of the cylinder head than a second joint portion (103A, 101A) between said rocker cover and said head side chain casing. Further, the block side chain casing is formed with an inclined wall (102B) extending downward at an inclination angle from the first joint portion toward the front end of the cylinder head.

In the chain casing for an engine according to the present invention, since the chain casing is formed with inner wall surfaces along which lubricant can smoothly flow downward on the basis of gravity without being accumulated midway along the wall surfaces, it is possible to allow engine lubricant to quickly and smoothly flow downward to the oil pan, thus preventing malsuction of the oil pump due to lack of the quantity of engine lubricant.

DETAILED DESCRIPTION OF THE PREFERRED EMBODIMENTS

An embodiment of the chain casing for an engine according to the present invention will be described in detail with reference to the attached drawings by taking the case where the present invention is applied to a DOHC engine.

Figure 1:
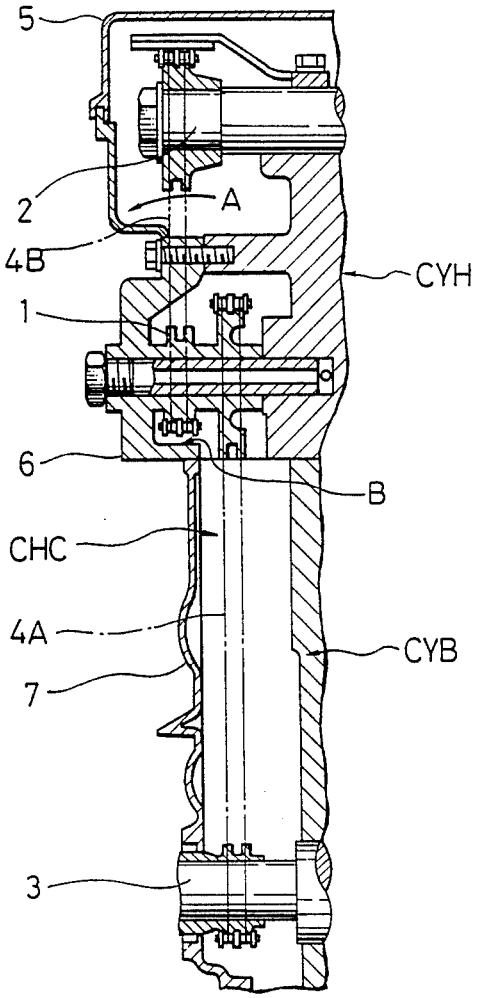
FIG. 1 PRIOR ART
FIG. 1 is a partial cross-sectional view showing a prior-art chain casing for an engine.
Figure 2:
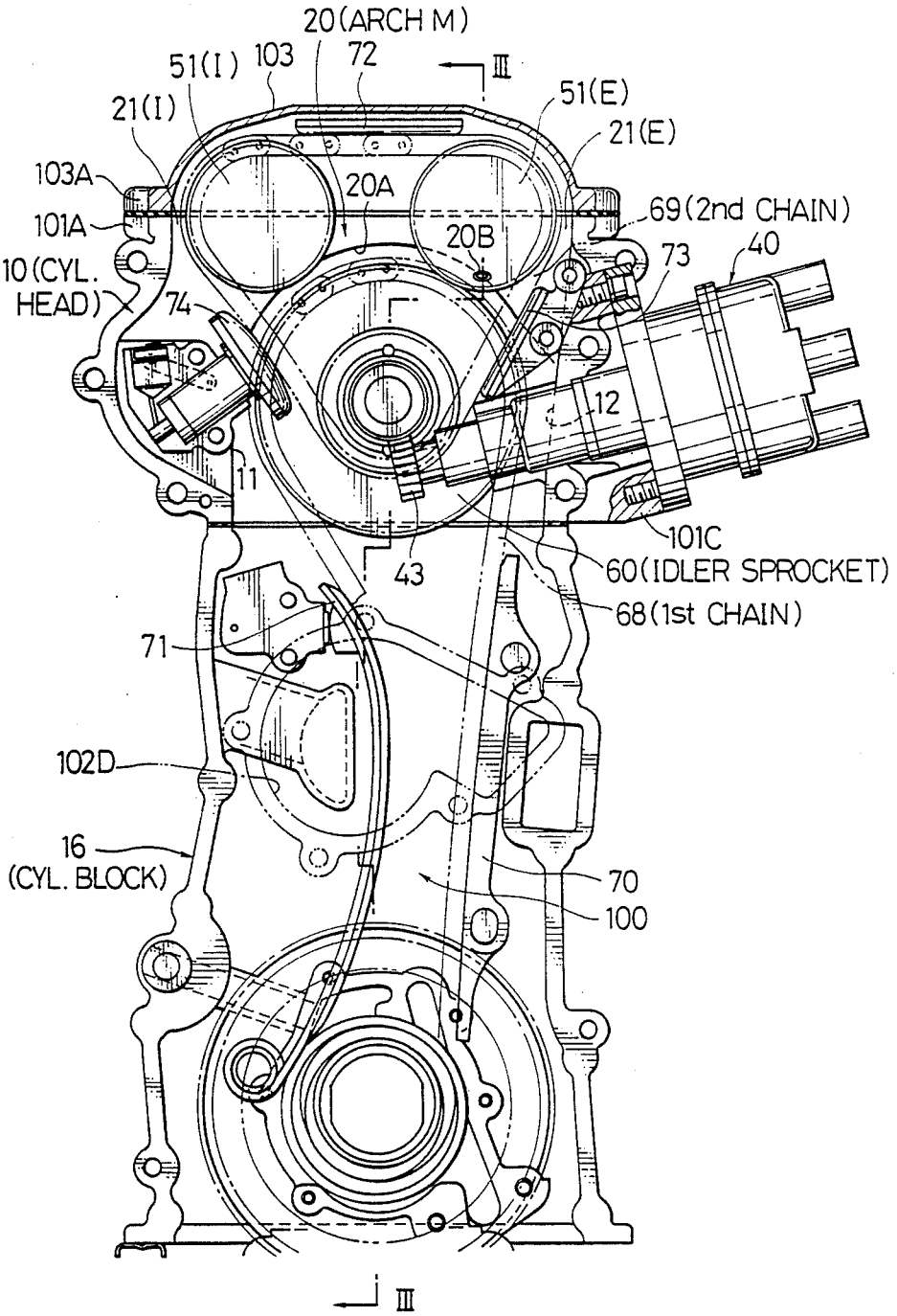
FIG. 2 is a front view showing a cylinder head, a cylinder block, and a camshaft and distributer driving mechanism, to which an embodiment of the chain casing for an engine according to the present invention is applied.
Figure 3:
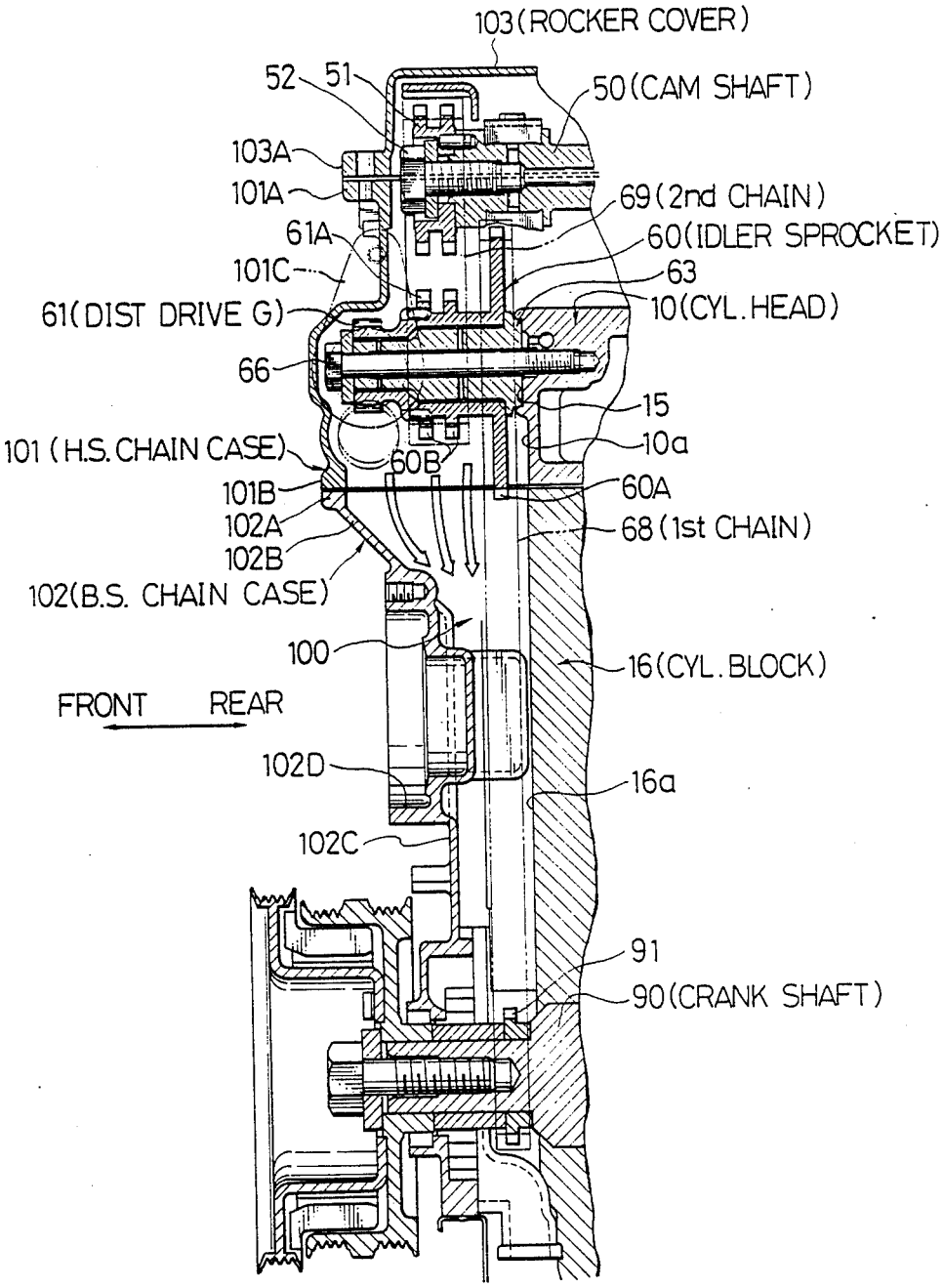
FIG. 3 is a partial cross-sectional view taken along the lines III—III in FIG. 2.

With reference to FIGS. 2 and 3, a two-camshaft and distributer driving mechanism will first be described, which is arranged between a cylinder head 10 and a head side chain case 101 and between a cylinder block 16 and a block side chain case 102.

In the two-camshaft and distributer driving mechanism, an idler sprocket 60 is provided between two camshafts 50 rotatably mounted on the cylinder head 10 and a crankshaft 90 rotatably supported by the cylinder block 16. The idler sprocket 60 is driven by the crankshaft 90 via a first chain 68; the two camshafts 50 are driven by the idler sprocket 60 via a second chain 69; and a distributer unit 40 is driven by a distributer driving gear 61 fixed to the idler sprocket 60. In addition, the distributer unit 40 is mounted on the head side chain case 101 at any desired inclination angle.

In more detail with reference to FIGS. 2 and 3, an intake camshaft 50(I) is supported at the intake camshaft bearing portion 21(I) of an arch member 20 formed integral with the cylinder head 10. An exhaust camshaft 50(E) is supported at the exhaust camshaft bearing portion 21(E) of the same arch member 20. Intake valves (not shown) are driven open or closed by the intake camshaft 50(I) and exhaust valves (not shown) are driven open or closed by the exhaust camshaft 50(E). An intake camshaft sprocket 51(I) having two sprocket wheels is fixed to the intake camshaft 50(I) by a bolt 52(I) and similarly an exhaust camshaft sprocket 51(E) having two sprocket wheels is fixed to the exhaust camshaft 50(E) by a bolt 52(E).

Under the two camshafts 50(I) and 50(E), an idler sprocket 60 and a helical distributer driving gear 61 fixed to the idler sprocket 60 are rotatably supported by an idler shaft 63 (fitted to a recess 15 formed in the cylinder head 10) via two bearing members, respectively. The idler sprocket 60, the helical distributer driving gear 61 and the idler shaft 63 are all mounted together on the cylinder head 10 with a bolt 66. The idler sprocket 60 is formed with a first sprocket (large diameter) chain wheel 60A and two second sprocket (small diameter) chain wheels 60B. The helical distributer driving gear 61 is fixed to the idler sprocket 60 with two pins 61A. The helical distributer driving gear 61 is engaged with the helical distributer driven gear 43 (FIG. 2). The helical driven gear 43 rotates at a rotative speed half of the crankshaft 90.

The first sprocket chain wheel 60A is driven by a crankshaft 90, because a first chain 68 is reeved around a crankshaft sprocket chain wheel 91 and the first sprocket chain wheel 60A of the idler sprocket 60. Further, the two intake and exhaust camshaft sprockets 51(I) and 51(E) are driven by the idler sprocket 60 in synchronism with the crankshaft 90, because a second chain 69 is reeved around the two second sprocket chain wheels 60B of the idler sprocket 60 and the two sprocket wheels 51 of each of the intake and exhaust camshafts 50(I) and 50(E).

As shown in FIG. 3, the first chain 68 is located being spaced away from a front wall **16*a* of the cylinder block 16, and the second chain 69 is located being further frontward spaced away from the first chain 68**.

As shown in FIG. 2, the first chain 68 is guided by a first chain guide 70, and an appropriate tension is applied to the first chain 68 by a first chain tensioner 71. In the same way, the second chain 69 is guided by two second chain guides 72 and 73, and an appropriate tension is applied to the second chain 69 by a second chain tension 74. Further, the first chain 68 is arranged under the arch member 20 near and along an inner arcuate wall 20A thereof formed so as to extend from the two inner side surfaces 11 and 12 of the cylinder head 10.

A chain casing for accommodating the above-mentioned camshaft and distributer driving mechanism will be described hereinbelow.

The chain casing for covering the first and second chains 68 and 69 is formed by a head side chain casing 101 fixed to the front end of the cylinder head 10, a block side chain casing 102 fixed to a front end of the cylinder block 16, and a rocker cover 103 fixed to both top ends of the cylinder head 10 and the head side chain casing 101.

In more detail with reference to FIG. 3, the head side chain casing 101 is formed with an upper joint flange 101A fixed to a flange 103A of the rocker cover 103, and a lower joint flange 101B fixed to an upper joint flange 102A of the block side chain casing 102. Therefore, the lower joint flange 101B of the head side chain casing 101 projects frontward from the upper joint flange 101A thereof to cover the distributer drive gear 61 fixed to the idler sprocket 60. On the other hand, the block side chain casing 102 is formed with the upper flange 102A fixed to the lower joint flange 101B of the head side chain casing 101, an inclined wall portion 102B extending downward and rearward at an inclination angle from the upper flange 102A thereof to a front end wall **16*a* of the cylinder block 16, and a vertical wall portion 102C for covering the first chain 68 in parallel to the first chain 68, when seen in cross section of the chain casing. In addition, the head side chain casing 101 is formed integral with an inclination bracket 101C to which the distributer unit 40 is fixed. The block side chain casing 102 is formed integral with a cylindrical recess 102D** to which a water pump (not shown) is fixed.

In operation, when the engine is running, since the crankshaft 90 is rotated, the idler sprocket 60 is driven by the crankshaft 90 via the first chain 68, so that the intake and exhaust camshaft sprockets 51(I) and 51(E) are driven by the idler sprocket 60 via the second chain 69 to open and close intake and exhaust valves at proper timing. On the other hand, since the helical distributer driving gear 61 is fixed to the idler sprocket 60, the distributer unit 40 is driven by the helical distributer driven gear 43 in mesh with the helical distributer driving gear 61, so that ignition plugs provided for engine cylinders, respectively are ignited in sequence by a high tension generated by the distributer unit 40 driven as described above.

During engine running, lubricant pressurized by an oil pump (not shown) is fed through a main oil passage (not shown) to the bearing portions of the two camshafts 50 and the intake and exhaust valves (not shown) mounted on the cylinder head 10. Further, lubricant is fed through the main oil passage to under the arch member 20, and then jetted from an oil jet hole 20B (FIG. 2) formed below the camshaft bearing portion 21 of the arch member 20, so that the chain chamber 100 covered by the head side chain casing 100 is filled with lubricant spray. The lubricant fed into the head side chain casing 101 as described above partly flows downward along the front end wall **10*a* of the cylinder head 10 and the front end wall 16*a* of the cylinder block 16, and partly sticks onto the second chain 69, the cam sprockets 51(I) and 51(E), the idler sprocket 60, the distributer driving gear 61, and the first chain 68 for lubrication, being partly scattered by high-speed rotating elements such as the camshaft sprockets, the idler sprocket, the gears, etc. Therefore, lubricant sticks onto the inner wall surfaces of both the head side chain casing 101 and the block side chain casing 102**.

In the chain casing according to the present invention, since the lower joint flange 101B (fixed to the block side chain casing 102) of the head side chain casing 101 is located frontward away from the upper joint flange 101A (fixed to the rocker cover 103) thereof, the lubricant smoothly flows downward along the inner surfaces of the chain casing from the head side chain casing 101 to the block side chain casing 102 on the basis of gravity without being accumulated in the head side chain casing 101.

In addition, since the inclined wall portion 102B is formed in the block side chain casing 102, the lubricant smoothly flows downward along the inner surfaces of the block side chain casing 102 also on the basis of gravity. In other words, since the lubricant will not be accumulated on the inner wall surfaces of the head side chain casing 101 and the block side chain casing 102, it is possible to quickly and smoothly return the lubricant into the oil pan without causing malsuction of the oil pump.

Further, in the ordinary engine, blow-by gas (compression and explosion gas blown from through gaps between cylinders and pistons into a crankcase) is usually introduced into the chain chamber 100 and then fed to the intake pipe (not shown) through under the rocker cover 103 for recirculation. In the chain chamber 100 according to the present invention, since the cross-sectional area of the chain chamber 100 increases in the upward direction due to the presence of the inclined wall portion 102B of the block side chain casing 102, it is possible to smoothly pass the blow-by gas through the chain chamber 100, thus additionally improving the recirculation effect of blown-by gas.

As described above, in the chain casing for an engine according to the present invention, the chain chamber 100 is composed of the rocker cover 103 fixed to the top end surface of the cylinder head 10; the head side chain casing 101 fixed to the front end surface of the cylinder head 10; and a block side chain casing 102 fixed to the front end surface of the cylinder block 16 in order to cover the two camshafts 50, the idler sprocket 60 and the first and second chains 68 and 69. Further, the lower joint flange 101B (to which the block side chain casing 102 is fixed) of the head side chain casing 101 is located ahead of the upper joint flange 101A (to which the rocker cover 103 is fixed) of the head side chain casing 101 and additionally the block side chain casing 102 is formed with the inclined wall portion 102B extending downward and rearward to the front end surface **16*a* of the cylinder block 16. Therefore, it is possible to allow lubricant sticking onto the inner wall surfaces of the rocker cover 103, the head side chain casing 101, and the block side chain casing 102** to quickly and smoothly flow downward into the oil pan on the basis of gravity, thus permitting a stable lubrication supply to various engine elements without causing malsuction of the oil pump due to lubricant accumulation on the inner wall surfaces of the chain chamber. In addition, it is possible to make compact the engine size by appropriately determining inner spaces between the chain casing and the two chains.

What is claimed is:

1. A chain casing for an engine having at least one camshaft mounted on a cylinder head and a crankshaft attached to a cylinder block, comprising:

(a) at least one camshaft sprocket coaxially coupled to the at least one camshaft;

(b) an idler sprocket rotatably supported between the camshaft and the crankshaft and on the cylinder block;

(c) a first chain reeved around the crankshaft and said idler sprocket to rotate said idler sprocket by the crankshaft;

(d) a second chain reeved around said idler sprocket and said camshaft sprocket to rotate said camshaft sprocket by said idler sprocket; and (e) a chain casing fixed to an end of the cylinder head and the cylinder block enclosing said idler sprocket, first and second chains, said chain casing being formed with contiguous inner wall surfaces extending from approximate said at least one camshaft to approximate said crankshaft along which lubricant can smoothly flow downward on the basis of gravity without being accumulated midway therealong.

2. The chain casing for an engine of claim 1, wherein said chain casing comprises:

(a) a head side chain casing fixed to a front end of the cylinder head, for covering said second chain;

(b) a rocker cover fixed to a top end of the cylinder head and to said head side chain casing, for covering said second chain in cooperation with said head side chain casing; and (c) a block side chain casing fixed to a front end of the cylinder block, for covering said first chain, a first joint portion between said head side chain casing and said block side chain casing being located farther frontward away from the front end of the cylinder head than a second joint portion between said rocker cover and said head side chain casing.

3. The chain casing for an engine of claim 2, wherein said block side chain casing is formed with an inclined wall extending downward at an inclination angle from the first joint portion toward the front end of the cylinder head.

* * * * *